United States Patent [19]

Vashi

[11] Patent Number: 4,497,667

[45] Date of Patent: Feb. 5, 1985

[54] PRETREATMENT COMPOSITIONS FOR METALS

[75] Inventor: Devendra C. Vashi, Lansdale, Pa.

[73] Assignee: Amchem Products, Inc., Ambler, Pa.

[21] Appl. No.: 512,513

[22] Filed: Jul. 11, 1983

[51] Int. Cl.[3] ..... C09K 3/00; C23G 1/20

[52] U.S. Cl. ..... 148/6.15 R; 106/287.19; 148/6.27

[58] Field of Search ..... 148/6.15 R, 6.27; 106/287.19; 164/6

[56] References Cited

U.S. PATENT DOCUMENTS

| | | | |
|---|---|---|---|
| 2,310,239 | 2/1943 | Jernstedt | 148/6 |
| 2,322,349 | 6/1943 | Jernstedt | 148/6 |
| 2,456,947 | 12/1948 | Jernstedt | 148/6.15 |
| 2,462,196 | 2/1949 | Jernstedt | 148/6.15 |
| 2,490,062 | 12/1949 | Jernstedt | 148/6.15 |
| 2,516,008 | 7/1950 | Lum | 148/6.15 |
| 2,874,081 | 2/1959 | Cavanagh | 148/6.15 |
| 3,741,747 | 6/1973 | Hamilton | 148/6.15 |
| 3,864,139 | 2/1975 | Heller | 106/287 |
| 4,370,173 | 1/1983 | Dollman | 134/40 |

*Primary Examiner*—Sam Silverberg

*Attorney, Agent, or Firm*—Ernest G. Szoke; Henry E. Millson, Jr.; Mark A. Greenfield

[57] ABSTRACT

Solid and aqueous compositions containing a Jernstedt salt, a phosphate, a polyphosphate, a silicate, a carbonate, a hydroxide, a sequestrant, an anionic surfactant and a non-ionic surfactant. The aqueous solutions can be used at temperatures as low as 100° F. to effectively clean and condition metallic surfaces prior to the application thereto of a conversion coating.

32 Claims, No Drawings

PRETREATMENT COMPOSITIONS FOR METALS

BACKGROUND OF THE INVENTION

This invention relates to compositions and methods for the treatment of metallic surfaces to improve their corrosion resistance and paint adhesion properties. It particularly relates to improved cleaning and titanating pretreatment compositions for the treatment of surfaces of metals such as iron, zinc, aluminum, and alloys of said metals prior to the application of a phosphate (usually zinc phosphate) coating on the surface of the metal.

The treatment of a metallic surface prior to the application of zinc phosphate coating involves the following sequence of steps:

(1) solvent degreasing (optional step, depending on contamination), (2) alkaline cleaning, (3) water rinse, (4) activating and grain-refining.

Step (4), the activating and grain-refining step is an important step in preparing the surface. Activation involves the conditioning of the metallic surface so that a zinc phosphate coating will form on it readily and quickly. Grain refining involves the conditioning of the surface to be treated so that the crystalline zinc phosphate coating when formed thereon is made up of very fine closely packed crystals. Such surfaces are superior, both in corrosion resistant and paint adherent properties, to coarse grained surfaces. Hereinafter, the term "conditioning" will be used to refer to activating and grain refining.

The most widely used method for conditioning the metallic surface is the application to said surface of an aqueous preparation of certain colloidal titanium salts. These salts, termed "Jernstedt salts", are disclosed in U.S. Pat. Nos. 2,310,239; 2,322,349; 2,456,947; 2,462,196; 2,490,062; 2,516,008 and 2,874,081. An explanation of the action of Jernstedt salts is given in U.S. Pat. No. 3,741,747.

From an operational point of view it was considered desirable to combine the cleaning step (usually carried out at high pH's) and the conditioning step in a single step. However, the stability of the colloidal dispersion of the titanium salts ia adversely affected at high pH's as the colloid tends to break up, with the result that it no longer properly conditions the metallic surface.

The problem with respect to the stability of the colloid at higher pH's has been solved by the addition of stabilizing agents to the cleaning-conditioning composition. Such agents include sodium tripolyphosphate and silicates, preferably in combination, and as described in U.S. Pat. No. 3,741,747, it is possible to obtain cleaning-conditioning compositions which are stable and effective when used in aqueous media at pH's above 10. U.S. Pat. No. 3,741,747 also discloses the inclusion of non-ionic surfactants as aids in cleaning and foam control.

The composition is added to water prior to carrying out the cleaning-conditioning step. This water is untreated and invariably contains certain metallic ions, particularly those of the alkaline earth metals, which also adversely affect the stability of the colloidal dispersion of the titanium salts. It has been found, as described in U.S. Pat. No. 3,864,139, that the addition of chelating agents such as, for example, salts of ethylenediaminetetraacetic acid (EDTA) and citric acid, preferably the sodium salts, helps to stabilize the colloidal dispersion from the adverse effects of the alkaline earth and other metals present in the water.

The compositions described in U.S. Pat. Nos. 3,741,747 and 3,864,139 are suitable for the one-step cleaning and conditioning of the metallic surfaces. This step must, to provide effective cleaning and conditioning, be carried out at temperatures in the range of 120°–160° F. The higher end of this temperature range requires a large consumption of energy.

DESCRIPTION OF THE INVENTION

It is an object of this invention to provide a cleaning-conditioning composition which can be applied in an aqueous medium at temperatures as low as 100° F., e.g. in the range of about 100° to about 130° F., and still provide effective cleaning and conditioning in one step.

It is another object of this invention to provide such cleaning-conditioning composition which can also be effectively used at higher temperatures in the range of about 130° to about 160° F.

It is a further object of this invention to provide effective cleaning-conditioning compositions in which the colloidal titanium salt is stable at pH's above 10.

It is still another object of this invention to provide such compositions, as described above, which are low foaming.

Other objects will appear in the description which follows.

In accordance with this invention, cleaning-conditioning compositions containing Jernstedt salts and having a pH of above 10, which can be applied in an aqueous medium to metallic surfaces at a temperature of about 100° to about 130° F., preferably about 110° to about 120° F., retain their stability and provide effective cleaning and conditioning in one step.

The solid cleaning-conditioning compositions of the present invention are dry mixtures, preferably in powdered or granular form, comprised of the following ingredients, the amounts of said ingredients being given in weight percent;

- a titanium salt-from about 0.01 to about 0.18%, preferably from about 0.05 to about 0.15%, calculated as titanium ion;
- an alkali metal phosphate-from about 0.6 to about 16%, preferably from about 3.2 to about 12.7%, calculated as $PO_4$;
- an alkali metal polyphosphate-from about 3 to about 14.5%, preferably from about 4.0 to about 11.6%, calculated as $P_2O_5$;
- an alkali metal carbonate-from about 1.6 to about 37%, preferably from about 3.0 to about 25%, calculated as $CO_3$;
- an alkali metal hydroxide-from about 1.5 to about 11%, preferably from about 3.2 to about 6.4%, calculated as hydroxyl;
- an alkali metal salt of EDTA-from about 0.3 to about 9.3%, preferably from about 1.2 to about 6.2%, calculated as EDTA;
- an alkali metal silicate-from about 3.5 to about 41%, preferably from about 6.2 to about 37.4%, calculated as $SiO_3$;
- the low foaming anionic surfactant sodium butoxy ethoxy acetate-from about 1 to about 15%, preferably from about 2 to about 10%, and
- a non-ionic surfactant-from about 0.1 to about 7.5%, preferably from about 1 to about 5%.

Any alkali metal is suitable as a component of the alkali metal compounds given above; however, from a cost basis the sodium or potassium compounds are generally used, with the sodium being preferred.

The titanium salt can be any titanium salt that will form a stable colloidal suspension in an aqueous solution of the above described composition. Suitable titanium salts include titanium fluoride, titanium chloride, titanium sulfate, potassium titanium fluoride, potassium titanium oxalate, and the like. The preferred compound is potassium titanium fluoride ($K_2TiF_6$).

Suitable phosphates include the primary, secondary and tertiary alkali metal salts of orthophosphoric acid and mixtures thereof. The preferred salt is disodium hydrogen phosphate.

The alkali metal polyphosphates include both poly- and pyrophosphates and mixtures thereo. The preferred compound is sodium tripolyphosphate.

The alkali metal carbonates include the carbonates, bicarbonates, and sesquicarbonates, and mixtures thereof. The preferred compound is sodium carbonate which is used as soda ash.

The preferred alkali metal salt of EDTA is $Na_4EDTA.4H_2O$. Other compounds which may advantageously be used in place of this salt include alkali metal salts of nitrilo-triacetic acid, diethylenetriamine-pentaacetic acid, and di- and tri-alkali metal EDTA, as well as citrates of sodium, potassium and ammonium, and alkali metal tartrates, succinates, salicyclates, and benzoates.

The alkali metal silicates include meta- and ortho-silicates, and mixtures thereof. Sodium metasilicate is preferred.

Sodium butoxy ethoxy acetate is commercially available under the trademark MIRAWET-B (Miranol Chemical Co.). MIRAWET-B, a low foaming anionic surfactant, is effective in the high alkaline range of the cleaning-conditioning compositions of this invention and is suitable for use over a wide temperature range without any adverse effects on the stability of the colloidal titanium salts. Other low foaming anionic surfactants that have the above advantages can be used in place of MIRAWET-B.

Suitable nonionic surfactants include Surfonic LF-17 (Texaco Chemical Co.), TRITON DF-16 (Rohm & Haas Co.), MAKON NF-12 (Stepan Chemical Co.) and the like, and mixtures thereof. Surfonic LF-17, which is an alkyl polyoxyalkylene ether is preferred. TRITON DF-16 is a modified polyethoxylated straight-chain alcohol. MAKON NF-12 is an alkylphenoxy polyoxyethylene ethanol.

The titanium salt and the alkali phosphate are mixed in desired proportions to obtain the Jernstedt salt. This may be done according to the procedure given in Example I of U.S. Pat. No. 3,864,139. The Jernstedt salt preferred for use in the compositions of this invention contains about 95% by weight of $Na_2HPO_4$ and about 5% by weight of $K_2TiF_6$.

In preparing the compositions of this invention, the dry materials in finely divided form are placed in a blender and mixed until a substantially uniform mixture is obtained. Any standard blender suitable for mixing solids may be used. The blended mixture is then dissolved in water for application to metallic surfaces as a cleaning-conditioning composition.

The aqueous cleaning-conditioning compositions of the invention are prepared by adding the solid compositions of the invention to water in an amount of from about 6 to about 25 g/l, preferably from about 8 to about 20 g/l for spray cleaning and from about 8 to about 30 g/l, preferably from about 10 to about 25 g/l for dip cleaning. These solutions have pH's in excess of 10 and are stable, with no signs of breakdown of the colloidal titanium salt; the colloid being formed when the compositions are added to the water.

The above aqueous cleaning-conditioning compositions are employed by heating the aqueous composition to a temperature of from about 100° to about 130° F., preferably from about 110° to about 120° F., and then applying the solution to the surface of the metal, which metal can be iron, zinc (or zinc coated ferrous), aluminum, or an alloy of such metals, by either spraying the solution onto the surface or dipping (immersing) the metal into the solution. Contact times of from about 30 seconds to about 3 minutes, preferably from about 1 minute to about 3 minutes are used for spraying and from about 1 minute to about 5 minutes, preferably from about 2 minutes to about 3 minutes are used for dipping. The colloid in the aqueous compositions of the invention remains stable during the application thereof and there are no problems with foaming. While these aqueous solutions are preferably used at the relatively low temperatures given above, they can also be used, if desired, at temperatures of up to 160° F. without any problems as to stability and effectiveness.

The metallic surfaces treated as described above can then be treated with a conversion coating, such as a zinc phosphate or iron phosphate coating in accordance, for example, with procedures described in U.S. Pat. Nos. 3,741,747 and 3,864,139. The phosphate coatings are fine-grained, well defined, tight and uniform with no void areas.

The invention will be apparent from the compositions shown in the examples which follow. These examples are given by way of illustration and are not to be regarded as limiting. Examples I to V illustrate compositions within the scope of this invention; while Examples VI to IX illustrate compositions outside the scope and are given for purposes of comparison.

EXAMPLE I

| Components | % by Weight |
|---|---|
| Sodium tripolyphosphate (anhyd.) | 16.00 |
| Soda ash | 16.00 |
| Sodium metasilicate (anhyd.) | 40.00 |
| Caustic soda (NaOH) | 10.00 |
| Jernstedt salt (5 wt. % $K_2TiF_5$ + 95 wt. % $Na_2HPO_4$) | 8.00 |
| $Na_4EDTA \cdot 4H_2O$ | 4.00 |
| MIRAWET-B | 5.00 |
| SURFONIC LF-17 | 1.00 |

The pH of an aqueous solution of this composition having from 6 to 30 g/l thereof is at least 10. The composition of Example I contains 0.068% of titanium ion, 5.08% of $PO_4$, 9.25% of $P_2O_5$ (in the tripolyphosphate), 9.05% carbonate (in the soda ash), 4.26% hydroxyl, 2.55% of EDTA, and 20.3% of silicate. The ratio of the non-ionic to the anionic surfactant is 1:5.

EXAMPLES II–V

| | Example | | | |
|---|---|---|---|---|
| Components | II | III | IV | V |
| Sodium tripolyphosphate (anhyd.) | 14 | 18 | 16 | 16 |
| Soda ash | 16 | 16 | 16 | 14 |
| Sodium metasilicate (anhyd.) | 40 | 40 | 38 | 40 |
| Caustic soda | 10 | 10 | 10 | 10 |
| Jernstedt salt | 8 | 8 | 8 | 10 |

-continued

| Components | Example II | III | IV | V |
|---|---|---|---|---|
| (5 wt. % $K_2TiF_6$ + 95 wt. % $Na_2HPO_4$) | | | | |
| $Na_4EDTA \cdot 4H_2O$ | 6 | 2 | 4 | 4 |
| MIRAWET-B | 5 | 5 | 6 | 5 |
| SURFONIC LF-17 | 1 | 1 | 2 | 1 |

The numbers in the colums for Examples II–V above and VI–IX below refer to the weight percent of the respective component.

EXAMPLES VI–IX

| Components | Example VI | VII | VIII | IX |
|---|---|---|---|---|
| Sodium tripolyphosphate (anhyd.) | 20 | 16 | 16 | 40 |
| Soda ash | 16 | 9 | 16 | 16 |
| Sodium metasilicate (anhyd.) | 40 | 30 | 10 | 16 |
| Caustic soda | 10 | 10 | 40 | 10 |
| Jernstedt salt | 8 | 25 | 8 | 8 |
| (5 wt. % $K_2TiF_6$ + 95 wt. % $Na_2HPO_4$) | | | | |
| $Na_4EDTA \cdot 4H_2O$ | — | 4 | 4 | 4 |
| MIRAWET-B | 5 | 5 | 5 | 5 |
| SURFONIC LF-17 | 1 | 1 | 1 | 1 |

The solid compositions described in Examples I–V were added with stirring to water in a concentration of 15.0 g/l. These solutions had pH's ranging from 10.0 to 12.0 and were stable, showing no signs of breakdown of the colloidal titanium salt; the colloid having been formed when the composition was added to the water. The resulting aqueous compositions were then heated to a temperature of 120° F., and then each composition applied to the surface of six 4"×6" coupons of clean cold rolled steel (AISI 1010 low carbon steel alloy). The aqueous compositions were applied by spraying the metal coupons with the aqueous composition for 90 seconds. The colloid remained stable during the application and there were no problems with foaming.

The metallic surfaces treated as described above were then treated with a zinc phosphate coating solution containing the following quantities of ingredients:

Coating Bath

| Ingredient | Grams/Liter of Solution |
|---|---|
| $Zn^{\oplus\oplus}$ | 1.80 |
| $Ni^{\oplus\oplus}$ | 1.40 |
| NaOH (50% solution) | 4.4 |
| $H_3PO_4$ (100%) | 26.54 |
| $ClO_3^{\ominus}$ | 1.00 |
| $NO_3^{\ominus}$ | 2.90 |
| $NO_2^{\ominus}$ | 0.16 |
| $Fe^{\oplus\oplus\oplus}$ | 0.016 |

After the aqueous coating bath was formed as above, NaOH solution was added until the pH of the solution was about 3.0 to 3.5. The bath was then heated to 95° F. and the steel coupons were sprayed with the bath for 90 seconds, resulting in a zinc phosphate coating on the steel substrate.

The steel coupons were removed from the bath and rinsed with tap water to remove excess solution. The steel coupons were then rinsed with distilled water at room temperature and air dried.

The phosphate coating on all of the steel coupons was fine-grained, well defined, tight and uniform with no void areas. Table I below shows a comparison of the properties of the phosphate coatings obtained after treatment of steel coupons with an aqueous solution of the composition of Example I and also of Examples VI to IX (six coupons per solution), using the same procedures and quantities of compositions as are given above for Examples I–V.

TABLE I

| Solution of Example | Variation from compositions of the invention | Nature of Phosphate Coating |
|---|---|---|
| I | — | Fine-grained, well defined, tight and uniform coating with no void areas. |
| VI | EDTA component omitted | Poor grain refinement and titanium stability. |
| VII | High titanium content | Thin, coarsely crystalline coating with void areas. |
| VIII | High caustic soda content(in place of some sodium metasilicate) | Grain refinement and titanium stability decreased, which resulted in a thin powdery coating. |
| IX | High sodium tripolyphosphate content. | Medium size crystals, non-uniform coating with some void spots. |

The results given in the above table clearly show that variations in the compositions outside the disclosed ranges result in metallic surfaces treated therewith on which phosphate coating having desired properties are not obtained.

What is claimed is:

1. A solid composition for use in aqueous solution in the cleaning and conditioning of the surface of a metal selected from the group consisting of iron, zinc, aluminum, and alloys of said metals, prior to the application on said surface of a conversion coating, which solid composition contains in percent by weight:

(i) a titanium salt in an amount from about 0.01 to about 0.18%, calculated as titanium ion, (ii) an alkali metal phosphate selected from the group consisting of mono-, di- and tri-alkali metal orthophosphates and mixtures thereof, in an amount from about 0.6 to about 16%, calculated as $PO_4$, (iii) an alkali metal polyphosphate or pyrophosphate or mixtures of said polyphosphate and pyrophosphate, in an amount from about 3 to about 14.5%, calculated as $P_2O_5$, (iv) an alkali metal carbonate selected from the group consisting of alkali metal carbonates, bicarbonates, and sesquicarbonates and mixtures thereof, in an amount from about 1.6 to about 37%, calculated as $CO_3$, (v) an alkali metal hydroxide in an amount from about 1.5 to about 11%, calculated as hydroxyl, (vi) an alkali metal salt of EDTA in an amount from about 0.3 to about 9.3%, calculated as EDTA.

(vii) an alkali metal silicate selected from the group consisting of alkali metal metasilicates, alkali metal orthosilicates, and mixtures thereof, in an amount from about 3.5 to about 41%, (viii) the anionic surfactant sodium butoxy-ethoxyacetate in an amount from about 1 to about 15%, and (ix) a non-ionic surfactant in an amount from about 0.1 to about 7.5%.

2. A composition according to claim 1 wherein the alkali metal is sodium or potassium.

3. A composition according to claim 2 wherein the alkali metal is sodium.

4. A composition according to claim 3 wherein the titanium salt is $K_2TiF_6$, the alkali metal phosphate is $Na_2HPO_4$, the alkali metal polyphosphate or pyrophosphate is sodium tripolyphosphate, the alkali metal carbonate is $Na_2CO_3$, the alkali metal hydroxide is NaOH, the alkali metal salt of EDTA is a tetrasodium salt thereof, and the alkali metal silicate is sodium metasilicate.

5. A composition according to claim 1 which contains the following components in percent by weight:

(i) in an amount from about 0.05 to about 0.15%, calculated as titanium,
(ii) in an amount from about 3.2 to about 12.7%, calculated as $PO_4$,
(iii) in an amount from about 4.0 to about 11.6%, calculated as $P_2O_5$,
(iv) in an amount from about 3.0 to about 25%, calculated as $CO_3$,
(v) in an amount from about 3.2 to about 6.4%, calculated as hydroxyl,
(vi) in an amount from about 1.2 to about 6.2%, calculated as EDTA,
(vii) in an amount from about 6.2 to about 37.4%, calculated as $SiO_3$,
(viii) in an amount from about 2 to about 10%, and
(ix) in an amount from about 1 to about 5%.

6. A composition according to claim 4 which contains in percent by weight:

(i) $K_2TiF_6$ in an amount from about 0.05 to about 0.15%, calculated as titanium,
(ii) $Na_2HPO_4$ in an amount from about 3.2 to about 12.7%, calculated as $PO_4$,
(iii) sodium tripolyphosphate in an amount from about 4.0 to about 11.6%, calculated as $P_2O_5$,
(iv) sodium carbonate in an amount from about 3.0 to about 25%, calculated as $CO_3$, (v) sodium hydroxide in an amount from about 3.2 to about 6.4%, calculated as hydroxyl,
(vi) $Na_4EDTA$ in an amount from about 1.2 to about 6.2%, calculated as EDTA,
(vii) sodium metasilicate in an amount from about 6.2 to about 37.4%, calculated as $SiO_3$,
(viii) sodium butoxy-ethoxy-acetate in an amount from about 2 to about 10%, and
(ix) non-ionic surfactant in an amount from about 1 to about 5%.

7. A composition according to claim 6 wherein the $K_2TiF_6$ and $Na_2HPO_4$ are in the form of a Jernstedt salt containing about 5% of $K_2TiF_6$ and about 95% $Na_2HPO_4$.

8. A solid composition for use in aqueous solution in the cleaning and conditioning of the surface of a metal selected from the group consisting of iron, zinc, aluminum, and alloys of said metals, prior to the application on said surface of a phosphate coating, which solid composition contains in approximate percent by weight:

(i) sodium tripolyphosphate—16.00
(ii) sodium carbonate—16.00
(iii) sodium metasilicate—40.00
(iv) sodium hydroxide—10.00
(v) Jernstedt salt—8.00
(vi) $Na_4EDTA.4H_2O$—4.00
(vii) sodium butoxy-ethoxy-acetate—5.00
(viii) nonionic surfactant—1.00 said Jernstedt salt being composed of about 5.0% by weight of $K_2TiF_6$ and about 95% by weight of $Na_2HPO_4$.

9. An aqueous solution of the solid composition of claim 1 which contains from about 6 to about 30 g of the solid composition per liter of solution, said solution having a pH in excess of 10.

10. An aqueous solution in accordance with claim 9 for spraying on metallic surfaces, which contains from about 6 to about 25 g of the solid composition per liter of solution.

11. An aqueous solution in accordance with claim 10 which contains from about 8 to about 20 g of the solid composition per liter of solution.

12. An aqueous solution in accordance with claim 9, into which metallic surfaces are dipped, which contains from about 8 to about 30 g of the solid composition per liter of solution.

13. An aqueous solution in accordance with claim 12 which contains from about 10 to about 25 g of the solid composition per liter of solution.

14. An aqueous solution of the solid composition of claim 5 which contains from about 6 to about 30 g of the solid composition per liter of solution, said solution having a pH in excess of about 10.

15. An aqueous solution in accordance with claim 14, for spraying on metallic surfaces, which contains from about 6 to about 25 g of the solid composition per liter of solution.

16. An aqueous solution in accordance with claim 15 which contains from about 8 to about 20 g of the solid composition per liter of solution.

17. An aqueous solution in accordance with claim 14, into which metallic surfaces are dipped, which contains from about 8 to about 30 g of the solid composition per liter of solution.

18. An aqueous solution in accordance with claim 17 which contains from about 10 to about 25 g of the solid composition per liter of solution.

19. An aqueous solution of the solid composition of claim 6 which contains from about 6 to about 30 g of the solid composition per liter of solution, said solution having a pH in excess of about 10.

20. An aqueous solution in accordance with claim 19, for spraying on metallic surfaces, which contains from about 6 to about 25 g of the solid composition per liter of solution.

21. An aqueous solution in accordance with claim 20 which contains from about 8 to about 20 g of the solid composition per liter of solution.

22. An aqueous solution in accordance with claim 19, into which metallic surfaces are dipped, which contains from about 8 to about 30 g of the solid composition per liter of solution.

23. An aqueous solution in accordance with claim 22 which contains from about 10 to about 25 g of the solid composition per liter of solution.

24. A process for the cleaning and conditioning of the surface of a metal selected from the group consisting of iron, zinc, aluminum, and alloys thereof, prior to the application on said surface of a conversion coating, which comprises contacting said surface with an aqueous solution in accordance with claim 9 at a temperature of from about 100° to about 160° F.

25. A process in accordance with claim 24 wherein the temperature is from about 100° to about 130° F.

26. A process in accordance with claim 24 wherein the temperature is from about 110° to about 120° F.

27. A process in accordance with claim 24 wherein the aqueous solution employed is the solution in accordance with claim 10 and said solution is sprayed on the metal surface.

28. A process in accordance with claim 27 wherein the aqueous solution employed is the solution in accordance with claim 15.

29. A process in accordance with claim 27 wherein the aqueous solution employed is the solution in accordance with claim 20.

30. A process in accordance with claim 24 wherein the aqueous solution employed is the solution in accordance with claim 12.

31. A process in accordance with claim 29 wherein the aqueous solution employed is the solution in accordance with claim 17.

32. A process in accordance with claim 29 wherein the aqueous solution employed is the solution in accordance with claim 22.

* * * * *